United States Patent [19]

Smith

[11] Patent Number: 5,074,423

[45] Date of Patent: Dec. 24, 1991

[54] LOW-PROFILE LIFTING APPARATUS

[75] Inventor: Glenn S. Smith, Issaquah, Wash.

[73] Assignee: Ingersoll-Rand Company, Phillipsburg, N.J.

[21] Appl. No.: 685,994

[22] Filed: Apr. 11, 1991

Related U.S. Application Data

[63] Continuation of Ser. No. 358,709, May 26, 1989, abandoned.

[51] Int. Cl.[5] ..... B66C 11/16

[52] U.S. Cl. ..... 212/135; 212/133; 212/134; 212/147; 254/311; 254/358

[58] Field of Search ..... 212/205, 218, 219, 133, 212/134, 135, 142.1, 147, 148; 254/311, 372, 358, 336, 337, 327; 104/95; 294/82.11

[56] References Cited

U.S. PATENT DOCUMENTS

| | | | |
|---|---|---|---|
| 272,439 | 2/1883 | Haskins | 212/133 |
| 811,077 | 1/1906 | Moore | 212/135 |
| 836,451 | 11/1906 | Moore | 212/133 |
| 874,105 | 12/1907 | Moore | 212/133 |
| 878,226 | 2/1908 | Moore | 212/135 |
| 1,005,452 | 10/1911 | Moore | 212/134 |
| 1,130,420 | 3/1915 | Moore | 212/134 |
| 1,195,985 | 8/1916 | Grant . | |
| 1,248,980 | 12/1917 | Zetzman | 212/135 |
| 1,455,369 | 5/1923 | Valentine . | |
| 1,558,779 | 10/1925 | Bennington | 104/95 |
| 1,741,074 | 12/1929 | Rasmussen . | |
| 1,858,895 | 5/1932 | Juergens . | |
| 2,812,251 | 11/1957 | Miller et al. | 212/205 |
| 2,880,963 | 4/1959 | Ernst et al. | 254/172 |
| 3,223,248 | 12/1965 | Cowan | 212/142.1 |
| 3,339,753 | 9/1967 | Forster et al. | 212/205 |
| 4,114,855 | 9/1978 | Adamson | 254/358 |
| 4,221,301 | 9/1980 | Walerowski | 254/327 |
| 4,289,076 | 9/1981 | Miller | 104/95 |

FOREIGN PATENT DOCUMENTS

| | | | |
|---|---|---|---|
| 7239 | 1/1877 | Canada | 254/337 |
| 7466 | 9/1876 | France | 254/336 |
| 1041485 | 9/1983 | U.S.S.R. | 294/82.11 |
| 1203620 | 1/1986 | U.S.S.R. | 104/95 |
| 9357 | 4/1891 | United Kingdom | 254/337 |

*Primary Examiner*—Sherman Basinger
*Assistant Examiner*—Thomas J. Brahan
*Attorney, Agent, or Firm*—Christensen, O'Connor, Johnson & Kindness

[57] ABSTRACT

A low-profile lifting apparatus (10) for hoisting and moving objects along an I-beam (12), comprising a frame assembly (20), a drive system (44), a pulley assembly (56), and a hoist assembly (66). The drive system (44) includes a first drive roller (48), and a second drive roller (49) operatively connected to each other and positioned on opposite sides of the web (14) to drive the lifting apparatus (10) along the lower flange (16). The drive mechanism (50) includes a pulley chain (62) that is manually pulled by an operator to rotate the drive shaft (60) and the attached drive rollers (48) and (49). A block (74) has a hook (76) positioned laterally on one side of the lateral centerpoint (82) nearest the chain hoist (68). The load chain (86) passes downward from the frame assembly (20) to the pulley wheel (78), then back to the frame assembly (20), and laterally beneath the lower flange (16) to the frame assembly (20), then down to the pulley wheel (80) on the block (74), then back to the frame assembly (20) where it engages the chain hoist (68).

16 Claims, 2 Drawing Sheets

LOW-PROFILE LIFTING APPARATUS

This application is a continuation application based on prior copending application Ser. No. 07/358,709, filed on May 26, 1989, now abandoned.

TECHNICAL FIELD OF THE INVENTION

The present invention relates to lifting devices, and, more particularly, to a low-profile lifting apparatus for hoisting and moving objects along a beam.

BACKGROUND OF THE INVENTION

Lifting devices of the class referred to as crane hoists usually consist of a block and hook assembly suspended from a frame member that in turn is supported by one or more rollers on the lower flange of an I-beam. The block assembly is typically suspended from the frame by a cable that passes through a pulley sheave on the block. The cable is used to raise and lower the block assembly to thereby raise and lower a load supported by the hook. The hoist is either rolled by hand along the lower flange of the beam or a single roller is power driven to move the hoist along the beam.

These crane hoists have several drawbacks. First, having the block and hook assembly suspended by a cable or chain passing through a single pulley sheave is inherently unstable. A single pulley arrangement allows the suspended load to freely swing on the chain upon the slightest change in the speed or direction of movement of the hoist on the beam. In addition, the load can easily rotate, causing the chain to twist. This can result in damage to the chain and the load and possible injury to the operator or nearby workers. Furthermore, it has been found that a single drive wheel will lose traction and slip as it encounters irregularities along the lower flange of the I-beam. The resultant erratic stopping and starting of the crane hoist can cause swinging of the suspended load, resulting in additional forces being placed on the crane hoist and the beam. Having a drive wheel mounted on each side of the I-beam has been considered impractical because of the clearance required below the beam for drive shafts, which would interfere with the raising of the block, and, thus, limit the height to which a load can be raised.

Another drawback to these crane hoists is the uneven distribution of loads on the load supporting chains as a result of pulley sheave inefficiency. This uneven distribution of loads can cause the block to diverge from a level position as it is being raised and lowered. These and other disadvantages are overcome in the present invention.

SUMMARY OF THE INVENTION

A low-profile lifting apparatus for hoisting and moving objects along a beam is provided. The beam includes a vertical web having a longitudinal axis and a flange formed on a lower edge of the web that projects laterally outward from both sides of the web. The lifting apparatus comprises a frame having drive roller means in the form of a first drive roller and a second drive roller rotatably mounted thereon and positioned on opposite sides of the beam web to support and drive the frame along the beam flange. The first drive roller and the second drive roller are operatively connected to one another and are manually rotated through a drive pulley assembly. The lifting apparatus further includes a block assembly having a block, a load holding means in the form of a hook, and laterally positioned first and second pulley wheels that rotate about an axis transverse to the longitudinal axis of the beam. A support means in the form of a chain is engaged with the first and second pulley wheels to laterally stabilize and support the block assembly beneath the frame. A manual lift pulley is provided for vertically raising and lowering the block assembly.

In accordance with another aspect of the present invention, the block includes a lateral center point and the hook is mounted on the block to be positioned on one side of the lateral center point for compensating for pulley wheel inefficiency to thereby maintain the block assembly in a horizontally level position as it is being raised and lowered.

In accordance with another aspect of the present invention, the lifting apparatus further includes one or more guide plates attached to the frame for guiding the frame along the beam flange. The guide plates have a laterally extending upper leg and a laterally extending lower leg projecting above and below the beam flange respectively for limiting vertical movement of the frame with respect to the beam flange. The guide plate includes a center member attached to the upper and lower legs and mounted to the frame to be positioned adjacent the beam flange to restrict lateral movement of the frame along the beam flange.

As will be readily appreciated from the foregoing description, the low-profile motorized lifting apparatus will have a smoother and more stable ride along the beam flange because the two opposed drive rollers enable constant contact with the beam flange by at least one of the rollers. This overcomes imbalanced conditions resulting from high center loading and enables movement over irregularities in the beam flange surface. This also aids in stabilizing the load on the block assembly as the lifting apparatus is moving. The lifting apparatus is further vertically and horizontally stabilized on the beam flange by the guide plates. The offset hook on the block compensates for pulley sheave inefficiency to maintain the block in a horizontally level position as it is being raised and lowered.

BRIEF DESCRIPTION OF THE DRAWINGS

The foregoing and other features and advantages of the present invention will become better understood from the following detailed description of the preferred embodiment of the invention when considered in conjunction with the accompanying drawings wherein.

DETAILED DESCRIPTION OF THE PREFERRED EMBODIMENT

Figure 1:
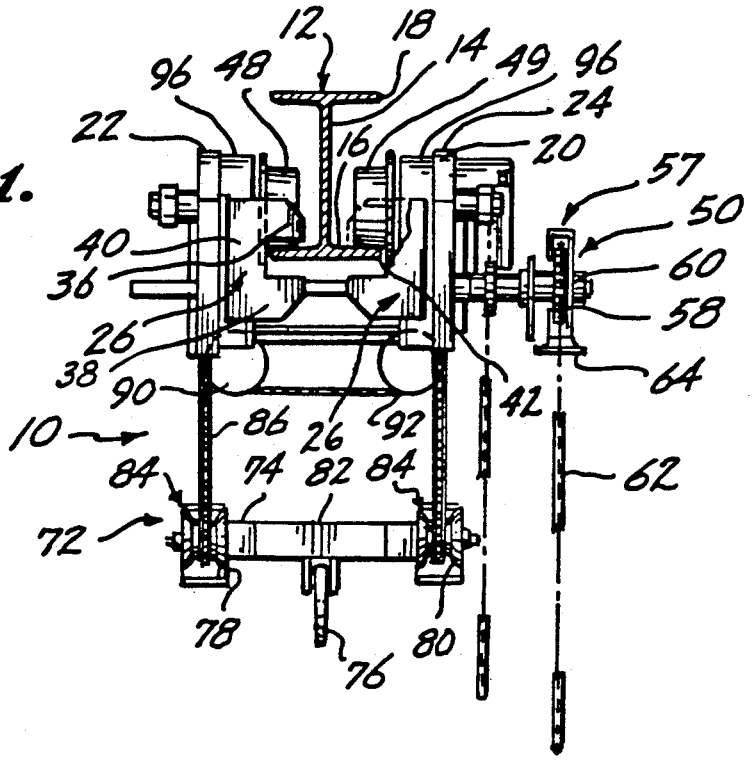
FIG. 1 is a front elevational view of a low-profile lifting apparatus formed in accordance with the present invention as mounted on an I-beam.
Figure 2:
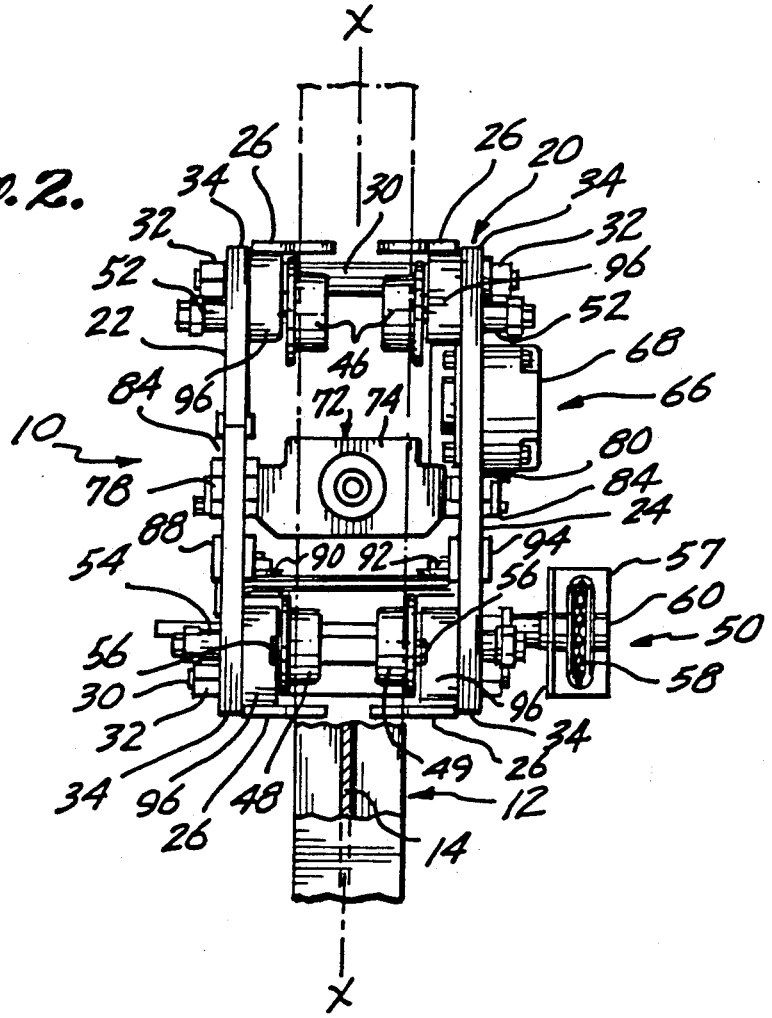
FIG. 2 is a top plan view of the lifting apparatus of FIG. 1.
Figure 3:
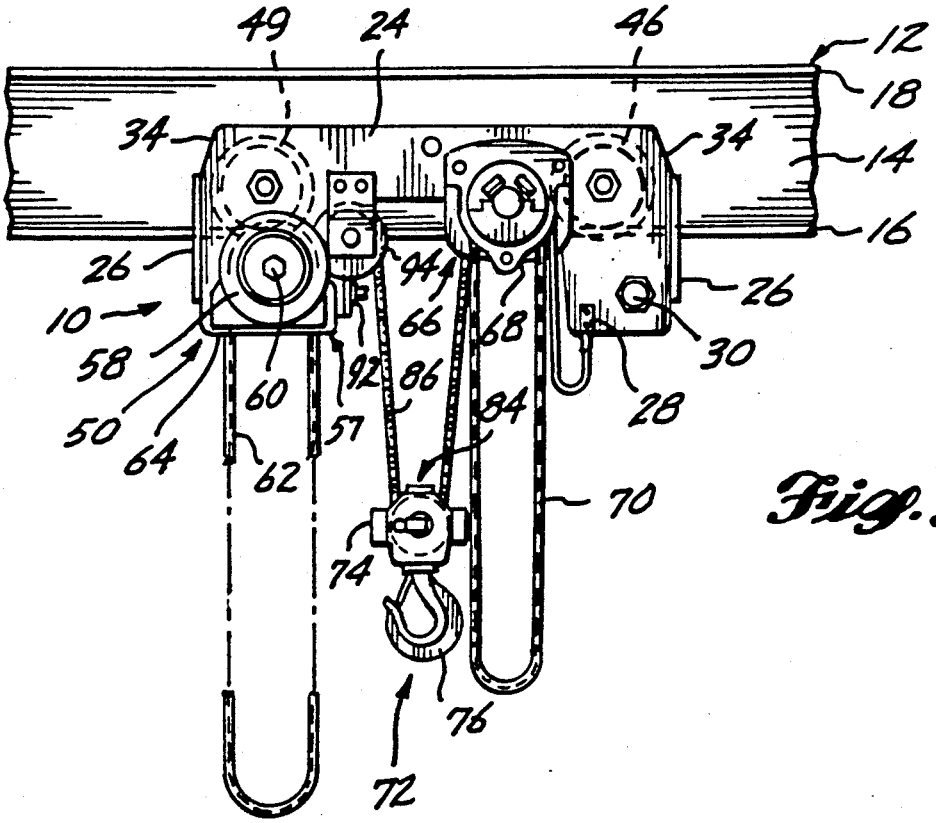
FIG. 3 is a side elevational view of the lifting apparatus of FIG. 1 as viewed from the drive side.
Figure 4:
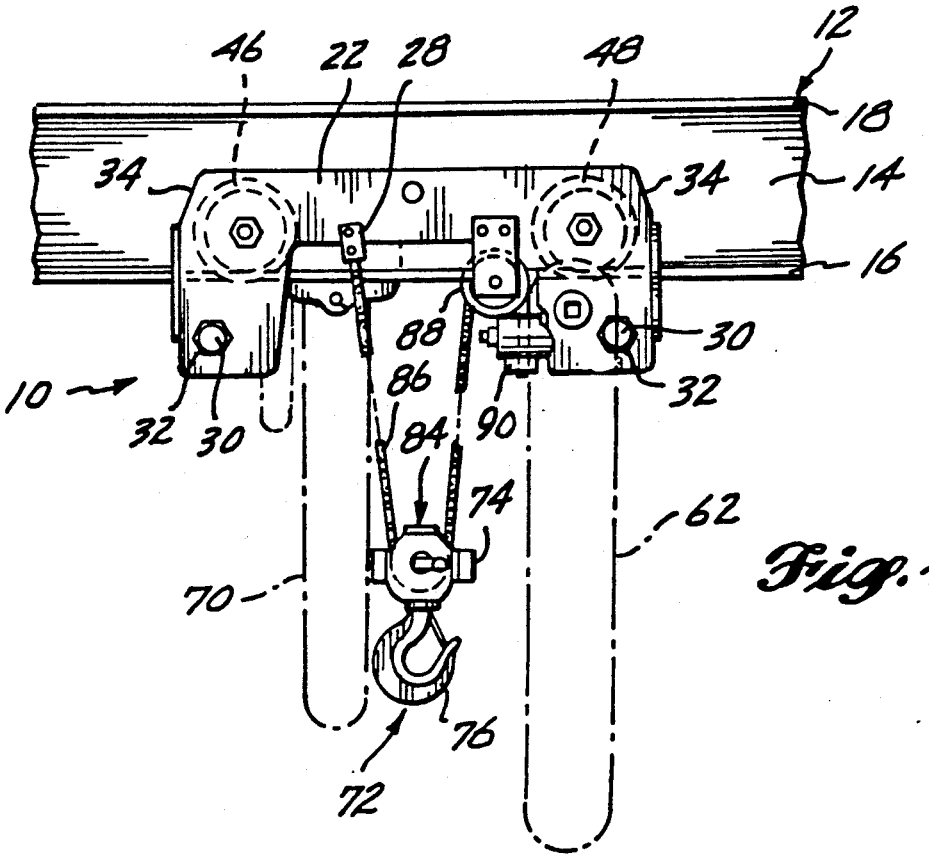
FIG. 4 is a side elevational view of the opposite side of the lifting apparatus formed in accordance with the present invention.

FIG. 1 illustrates a low-profile lifting apparatus 10 rollably mounted on an I-beam 12. The I-beam 12, shown for purposes of illustration, has a longitudinal axis X and includes of a vertically oriented web 14 having an integral lower flange 16 and an integral upper flange 18. The upper flange 18 may be formed as part of a ceiling or other mounting member to which the web 14 is attached. In order to save space, it is desirable that the lower flange 16 be as close to the ceiling as possible. Consequently, the lifting apparatus 10 is designed to have a low profile to enable mounting on the I-beam 12 and to attain a maximum lifting height.

The lifting apparatus 10 is supported on the I-beam 12 through a frame assembly 20 that includes a chain side plate 22, a hoist side plate 24, guide plates 26, a chain anchor 28, and two suspension shafts 30. The suspension shafts 30 pass through the chain side plate 22, beneath the lower flange 16, and through the hoist side plate 24 to rigidly hold the side plates 22 and 24 in an upright position such that the plates 22 and 24 are parallel to one another and parallel to the longitudinal axis X of the I-beam 12. The suspension shafts 30 are retained in place with suitable fasteners 32 that are removed to permit disassembly and mounting of the lifting apparatus 10 on the I-beam 12.

The side plates 22 and 24 have attached at each of their ends 34 a C-shaped guide plate 26. As shown in FIG. 1, each guide plate 26 includes an upper leg 36, a lower leg 38, and a center member 40 connected to the upper leg 36 and lower leg 38. Each center member 40 is attached to the respective side plates 22 and 24 so that the upper leg 36 projects laterally over the lower flange 16 and the lower leg 38 projects laterally beneath the lower flange 16. When so assembled, the upper and lower legs 36 and 38 restrict vertical movement of the frame assembly 20 on the I-beam 12 as the lifting apparatus 10 is moving thereon or when a load is being attached to or removed from the lifting apparatus 10. In addition, the center members 40, which are positioned adjacent the outside edges 42 of the lower flange 16, restrict lateral movement of the frame assembly 20 on the I-beam 12.

Mounted to the frame assembly 20 is a drive system that includes a pair of idler rollers 46, a pair of drive rollers 48 and 49 and a drive mechanism 50. The idler rollers 46 are rotatably mounted on idler shafts 52 attached near one end of each side plate 22 and 24 to roll upon the lower flange 16 on opposite sides of the web 14. Likewise, the first drive roller 48 and the second drive roller 49 are rotatably mounted on individual axle shafts 54 positioned near the other end of each side plate 22 and 24, respectfully, such that the drive rollers 48 and 49 roll along the lower flange 16 on opposite sides of the web 14. Each drive roller 48 and 49 has attached thereto or integrally formed therewith a spur gear 56 positioned between the drive rollers 48 and 49 and the side plates 22 and 24 for engagement with the drive mechanism 50.

The drive mechanism 50 comprises a manually operated pulley assembly 57 to drive the drive rollers 48 and 49. The pulley assembly 57 includes a chain pulley gear 58 mounted to a drive shaft 60. The drive shaft 60 passes transversely beneath the lower flange 16 and is journaled to rotate in the side plates 22 and 24. A pulley chain 62 engages the chain pulley gear 58 and is guided by chain guides 64 mounted to the hoist side plate 24 to maintain the pulley chain 62 in alignment with the chain pulley gear 58 and to protect an operator's hands from becoming pinched between the chain pulley gear 58 and pulley chain 62.

Pinion gears (not shown) are mounted on the drive shaft 60 in parallel axial alignment and engagement with the spur gears 57 on the drive rollers 48 and 49. Torque from rotation of the chain pulley gear 58 is transmitted through the drive shaft 60 to the drive rollers 48 and 49 to effect movement of the lifting apparatus 10 in a forward or reverse direction on the I-beam 12.

Mounted to the hoist side plate 24 is a hoist assembly 66 comprising a chain hoist 68 and a hand chain 70. The chain hoist 68 depicted in the representative embodiment described and illustrated herein is a commerically available unit and will not be described in detail. The chain hoist 68 achieves a mechanical advantage through gear ratios to raise and lower a block assembly 72 by means of the hand chain 70.

The block assembly 72 consists of a block 74, a load supporting hook 76, and a pair of pulley wheels 78 and 80. The block 74 has a lateral center point 82 at which the hook 76 is mounted. Located at each end of the block 74 is a pulley wheel housing 84 in which is mounted the pulley wheels 78 and 80 to rotate about an axis transverse to the longitudinal axis of the I-beam 12. The pulley wheel housings 84 are laterally spaced apart a distance such that as the block 74 is raised to its maximum height by the hoist assembly 66, the pulley wheels 78 and 80 will clear the lower flange 16 and will be on opposite sides of the I-beam 12.

The block assembly 72 is suspended from the frame assembly 20 by a load chain 86. One end of the load chain 86 is anchored to the chain side plate 22 by the chain anchor 28 that is attached to the chain side plate 22 by a fastener. The load chain 86 passes down and underneath the first pulley wheel 78, and then returns upward to the chain side plate 22 where it passes over a longitudinal idler sheave 88 that is mounted on the chain side plate 22 to rotate about an axis transverse to the longitudinal axis of the I-beam 12. The load chain 86 then passes downward and beneath a first transverse idler sheave 90 that is mounted on the chain side plate 22 to rotate about an axis parallel to the longitudinal axis of the I-beam 12. From there, the load chain 86 passes transversely beneath the lower flange 16 of the I-beam 12, and then beneath a second transverse idler sheave 92 mounted on the hoist side plate 24 to rotate about an axis parallel to the longitudinal axis of the I-beam 12.

The load chain 86 then passes up and around a second longitudinal idler sheave 94, and then downward and underneath the second pulley wheel 80 mounted on the block 74. From the second pulley wheel 80, the load chain 86 passes upward and engages the chain hoist 68. The other end of the load chain 86 is affixed to the hoist side plate 24 by a second chain anchor 28. The block assembly 72 is raised and lowered through the chain hoist 68 by an operator pulling on the hand chain 70.

It has been found that due to pulley inefficiency, i.e., friction losses in the bearings of the pulley sheaves, the block 74 will depart from a horizontally level position as the block is being raised and lowered. To compensate for this, the hook 76 is laterally offset from the lateral center point 82 toward the hoist side plate 24. This reduces the load on the pulley sheaves located on the chain side plate 22 and the pulley wheel 78 while conversely increasing the load on the pulley wheels near the chain hoist, thereby offsetting the pulley wheel friction losses. The amount of offset in the position of the hook 76 can be calculated from the predetermined efficiencies of the pulley sheaves, as is known by one of ordinary skill in the art.

Doubler plates 96 are welded at each end of each side plate 22 and 24 to space the side plates 22 and 24 away from the idler rollers 46, and the drive rollers 48 and 49. This places the side plates 22 and 24 in vertical alignment over the pulley wheels 78 and 80 mounted on the block 74 to facilitate smooth operation of the load chain 86 through the various pulley wheels. The doubler plates 96, side plates 22 and 24, and the block 74 are preferably constructed of high-strength low-carbon steel. The load chain 86 is preferably formed from quenched and tempered alloy steel that is surface-hardened through a heat treatment to achieve high strength and high resistance to wear. A nickle-diffused chain may be used in applications where rain, seawater, steam, chemicals or other harmful atmospheres are present.

When the lifting apparatus 10 is positioned over a load, the operator lowers the block assembly 72 by pulling on the hand chain 70, that in turn causes the chain hoist 68 to play out the load chain 86. The load is then attached to the supporting hook 76 and the operator pulls the hand chain 70 to cause the chain hoist 68 to bring in the load chain 86, thereby raising the block assembly 72 and the attached load.

It is to be understood that while a preferred embodiment of the invention has been illustrated and described, various changes can be made therein without the departing from the spirit and scope of the invention. Consequently, the invention can be practiced otherwise than as specifically described herein.

The embodiments of the invention in which an exclusive property or privilege is claimed are defined as follows:

1. A low-profile lifting apparatus for hoisting and moving objects along a beam, the beam including a vertically oriented web having a longitudinal axis and a flange formed on a lower edge of the web, the flange projecting laterally outward therefrom on both sides of the web, the lifting apparatus comprising:

a frame;

drive roller means rotatably mounted on said frame for supporting and driving the frame along the beam flange;

a first pulley means for rotating said drive roller means;

a block assembly, said block assembly including a block, load holding means mounted on said block for holding a load, and laterally positioned first and second pulley wheels rotatably mounted on said block for rotation about an axis lying transverse to the longitudinal axis of said beam;

elongate suspending means for suspending said block assembly beneath said frame, said elongate suspending means having one end affixed to one side of said frame, and then passing through said first pulley wheel, and then upward to said frame, thence laterally beneath said beam to said frame, and then down through said second pulley wheel to laterally stabilize and support said block assembly; and, a second pulley means rotatably mounted on the other side of said frame from the side to which said one end of said elongate suspending means is affixed for engaging the other end of said elongate suspending means, the axis of rotation of said second pulley means lying above the bottom of said beam flange, said elongate suspending means being wrapped around said second pulley means such that the rotation of said second pulley means extends and retracts said elongate suspending means to vertically raise and lower said block assembly with respect to said frame, said extension and retraction of said elongate suspending means and, thus, the raising and lowering of said block assembly being provided solely by the rotation of said second pulley means.

2. The apparatus of claim 1, wherein said drive roller means comprises a first drive roller and a second drive roller operatively connected to one another to support and drive the frame along the beam flange.

3. The apparatus of claim 2, wherein said firt drive roller and said second drive roller are positioned on opposite sides of the beam web.

4. The apparatus of claim 1, wherein said suspending means comprises a chain.

5. The apparatus of claim 4, wherein said block has a lateral center point and further wherein said load holding means is positioned laterally on one side of said lateral center point for compensating for pulley wheel inefficiency to thereby maintain the block assembly in a horizontally level position as it is being raised and lowered.

6. The lifting apparatus of claim 1, further comprising means attached to said frame for guiding said frame along the beam flange.

7. The lifting apparatus of claim 6, wherein said guide means comprises at least one guide plate mounted to said frame, said at least one guide plate having a laterally projecting upper leg that extends over the flange and a laterally projecting lower leg that extends underneath the flange, said upper and lower legs cooperating to limit vertical movement of said frame with respect to the beam flange, said at least one guide plate further comprising a central body member connecting said upper and lower legs and positioned adjacent the flange to limit lateral movement of the frame with respect to the beam.

8. The apparatus of claim 1, wherein said first and second pulley wheels on the block are laterally separated by more than the width of the beam.

9. A low-profile lifting apparatus for hoisting and moving objects along a beam, the beam including a vertically oriented web having a longitudinal axis and a flange formed on the lower edge of the web, the flange extending laterally outward on both sides of the web, the lifting apparatus comprising:

a frame, said frame including a first side plate and a second side plate, said first and said second side plates positioned on opposite sides of the beam web;

drive roller means rotatably mounted to said frame to support and drive said frame along the beam flange;

first pulley means for rotating the drive roller means;

a block assembly, said block assembly including a block, means for holding a load mounted on said block, and laterally positioned first and second pulley wheels rotatably mounted on said block to rotate about an axis transverse to the longitudinal axis of the beam; and, means for supporting said block assembly beneath said frame, said supporting means having one end affixed to said first side plate and passing down and under said first pulley wheel, then passing up and over a first idler sheave mounted on said first side plate to rotate about an axis transverse to the longitudinal axis of the beam, then passing down and under a second idler sheave mounted on said first side to rotate about an axis parallel to the longitudinal axis of the beam, the supporting means then passing laterally beneath the beam and under a third idler sheave mounted on said second side plate to rotate about an axis parallel to the longitudinal axis of the beam, passing up and over a fourth idler sheave mounted on said second side plate to rotate about an axis transverse to the longitudinal axis of the beam, said supporting means then passing down and under said second pulley wheel, and then passing up and engaging a second pulley means mounted on said second side plate, said second pulley means being manually operated to raise and lower said block assembly.

10. The lifting apparatus of claim 9, wherein said drive roller means comprises a first drive roller and a second drive roller operatively connected to one another to support and drive the frame along the beam flange.

11. The apparatus of claim 10, wherein said first drive roller and said second drive roller are positioned on opposite sides of the beam web.

12. The lifting apparatus of claim 9, wherein said support means comprises a chain.

13. The lifting apparatus of claim 9, further comprising means for guiding said frame along the beam flange.

14. The lifting apparatus of claim 13, wherein said guide means comprises at least one guide plate having upper and lower laterally extending legs and a center member attached to said legs and mounted to said frame such that said upper leg projects over the beam flange and said lower leg projects under the beam flange to restrict vertical and lateral movement of said frame on said beam flange.

15. The lifting apparatus of claim 9, wherein said block has a lateral center point and further wherein said load-holding means is mounted on said block and positioned laterally on one side of said lateral center point for compensating for pulley inefficiency to thereby maintain said block assembly in a horizontally level position as it is being raised and lowered.

16. The apparatus of claim 9, wherein said first and second pulley wheels on the block are laterally separated by more than the width of the beam.

* * * * *

UNITED STATES PATENT AND TRADEMARK OFFICE

CERTIFICATE OF CORRECTION

PATENT NO. : 5,074,423

DATED : December 24, 1991

INVENTOR(S) : G.S. Smith

It is certified that error appears in the above-identified patent and that said Letters Patent is hereby corrected as shown below:

| COLUMN | LINE | |
|---|---|---|
| 6 | 8 | "firt" should read --first--. |

Signed and Sealed this

Twenty-seventh Day of April, 1993

*Attest:*

MICHAEL K. KIRK

*Attesting Officer*

*Acting Commissioner of Patents and Trademarks*